US008162706B2

(12) United States Patent
Mizutani et al.

(10) Patent No.: US 8,162,706 B2
(45) Date of Patent: Apr. 24, 2012

(54) WATERCRAFT STEERING SYSTEM, AND WATERCRAFT

(75) Inventors: Makoto Mizutani, Shizuoka (JP); Ryuji Uchiyama, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 628 days.

(21) Appl. No.: 11/942,187

(22) Filed: Nov. 19, 2007

(65) Prior Publication Data

US 2008/0119094 A1 May 22, 2008

(30) Foreign Application Priority Data

Nov. 17, 2006 (JP) ..... 2006-312228

(51) Int. Cl.

| | |
|---|---|
| ***B63H 20/12*** | (2006.01) |
| ***B63H 25/02*** | (2006.01) |
| ***B63H 25/14*** | (2006.01) |
| ***B63H 25/20*** | (2006.01) |
| ***B63H 25/24*** | (2006.01) |
| ***B63H 25/42*** | (2006.01) |

(52) U.S. Cl. ..... 440/53; 440/1; 440/58; 114/144 R; 114/144 RE

(58) Field of Classification Search ..... 114/144 R, 114/150, 144 RE, 144 E; 440/1, 53, 58–60, 440/61 R, 61 S–61 C, 62, 63
See application file for complete search history.

(56) References Cited

U.S. PATENT DOCUMENTS

| | | | | |
|---|---|---|---|---|
| 2,215,003 | A | | 9/1940 | Johnson |
| 2,224,357 | A | | 12/1940 | Pecker |
| 3,084,657 | A | | 4/1963 | Kiekhaefer |
| 3,233,691 | A | | 2/1966 | De Blasi |
| 3,269,350 | A | * | 8/1966 | Stibbe et al. ..... 440/52 |
| 3,310,021 | A | | 3/1967 | Shimanckas |
| 3,336,891 | A | * | 8/1967 | Stark ..... 114/144 R |
| 3,349,744 | A | | 10/1967 | Mercier et al. |
| 3,374,761 | A | * | 3/1968 | Bretz ..... 114/150 |
| 3,495,564 | A | * | 2/1970 | Brockardt ..... 114/146 |
| 3,658,027 | A | * | 4/1972 | Sturges ..... 440/55 |
| 4,120,258 | A | | 10/1978 | Spurgin |
| 4,220,111 | A | | 9/1980 | Krautkremer et al. |
| 4,362,515 | A | * | 12/1982 | Ginnow ..... 440/62 |
| 4,373,920 | A | | 2/1983 | Hall et al. |

(Continued)

FOREIGN PATENT DOCUMENTS

GB 1 389 521 A 4/1975

(Continued)

OTHER PUBLICATIONS

English Translation of JP 02-258498 A.*

(Continued)

*Primary Examiner* — Ajay Vasudeva
(74) *Attorney, Agent, or Firm* — Keating & Bennett, LLP

(57) ABSTRACT

A watercraft can have an electric motor mounted on a screw bar extending in a right/left direction. The electric motor can move along the screw bar in the right/left direction to steer an outboard motor, or another part of a different marine propulsion system. One or more springs can be provided at the ends of the screw bar. When the outboard motor whose steered angle exists in a predetermined angle range including the maximum steered angle is steered back to a neutral position, either one of the springs presses the electric motor toward the center of the screw bar to assist the steering torque of the electric motor.

12 Claims, 10 Drawing Sheets

U.S. PATENT DOCUMENTS 4,500,298 A 2/1985 Hall et al.
4,519,335 A 5/1985 Krautkremer et al.
4,637,802 A 1/1987 Taguchi et al.
4,787,867 A 11/1988 Takeuchi et al.
4,872,857 A 10/1989 Newman et al.
4,908,766 A 3/1990 Takeuchi
4,909,765 A 3/1990 Riske et al.
5,029,547 A 7/1991 Novey
5,031,562 A 7/1991 Nakase et al.
5,231,888 A 8/1993 Katahira
5,235,927 A 8/1993 Singh et al.
5,244,426 A 9/1993 Miyashita et al.
5,253,604 A 10/1993 Bohlin
5,355,821 A * 10/1994 Johnson ..... 114/144 R
5,361,024 A 11/1994 Wisner et al.
5,370,564 A 12/1994 Fujimoto et al.
5,533,935 A 7/1996 Kast
5,800,223 A 9/1998 Iriono et al.
5,997,370 A 12/1999 Fetchko et al.
6,079,513 A 6/2000 Nishizaki et al.
6,138,596 A * 10/2000 Gonring et al. ..... 114/144 R
6,230,642 B1 5/2001 McKenney et al.
6,234,853 B1 5/2001 Lanyi et al.
6,273,771 B1 8/2001 Buckley et al.
6,341,992 B1 * 1/2002 Eglinsdoerfer et al. ..... 440/53
6,402,577 B1 6/2002 Treinen et al.
6,405,669 B2 6/2002 Rheault et al.
6,471,556 B1 10/2002 Yamashita et al.
6,511,354 B1 1/2003 Gonring et al.
6,535,806 B2 3/2003 Millsap et al.
6,561,860 B2 5/2003 Colyvas
6,655,490 B2 12/2003 Andonian et al.
6,671,588 B2 12/2003 Otake et al.
6,678,596 B2 1/2004 Husain et al.
6,796,856 B2 * 9/2004 Roycroft et al. ..... 440/12.51
6,843,195 B2 1/2005 Watabe et al.
6,855,014 B2 2/2005 Kinoshita et al.
6,892,661 B2 5/2005 Kishi et al.
6,892,662 B2 5/2005 Watanabe et al.
6,994,046 B2 2/2006 Kaji et al.
6,997,763 B2 2/2006 Kaji
7,004,278 B2 2/2006 Sugitani et al.
7,011,558 B2 * 3/2006 Roos ..... 440/62
7,063,030 B2 6/2006 Mizutani
7,140,315 B2 11/2006 Okuyama
7,156,034 B2 1/2007 Mizutani
7,267,069 B2 9/2007 Mizutani
7,267,587 B2 9/2007 Oguma et al.
7,270,068 B2 9/2007 Mizutani
7,497,746 B2 3/2009 Okuyama
2003/0077953 A1 4/2003 Kaji
2003/0150366 A1 8/2003 Kaufmann et al.
2003/0224670 A1 12/2003 Takada et al.
2003/0224672 A1 12/2003 Takada et al.
2004/0007644 A1 1/2004 Phelps et al.
2004/0031429 A1 2/2004 Kaufmann et al.
2004/0121665 A1 6/2004 Mizuguchi et al.
2004/0139902 A1 7/2004 Takada et al.
2004/0139903 A1 7/2004 Watabe et al.
2005/0118894 A1 6/2005 Kawanishi
2005/0121975 A1 6/2005 Gronau et al.
2005/0170712 A1 8/2005 Okuyama
2005/0170713 A1 8/2005 Okuyama
2005/0199167 A1 9/2005 Mizutani
2005/0199168 A1 9/2005 Mizutani
2005/0199169 A1 9/2005 Mizutani
2005/0282447 A1 12/2005 Okuyama
2006/0019558 A1 1/2006 Mizutani et al.
2006/0037522 A1 2/2006 Kaneko et al.
2006/0217012 A1 9/2006 Mizutani
2007/0049139 A1 3/2007 Mizutani
2007/0066154 A1 3/2007 Mizutani
2007/0066156 A1 3/2007 Mizutani
2007/0066157 A1 3/2007 Yamashita et al.
2007/0093147 A1 4/2007 Mizutani
2007/0105463 A1 5/2007 Mizutani

FOREIGN PATENT DOCUMENTS

JP 58-047598 U 3/1983
JP 62-166193 7/1987
JP 01-314695 12/1989
JP 02-179597 7/1990
JP 02-227395 9/1990
JP 02-258498 A 10/1990
JP 02258498 A * 10/1990
JP 03-148395 6/1991
JP 04-038297 2/1992
JP B-HEI 6-33077 5/1994
JP 2739208 B2 1/1998
JP 10-226346 8/1998
JP A-HEI 10-310074 11/1998
JP 2959044 B2 7/1999
JP 2000-313398 11/2000
JP 2000-318691 11/2000
JP 3232032 9/2001
JP A-2002-331948 11/2002
JP A-2004-155282 6/2004
JP 2005-212600 A 8/2005
JP 2005-254848 9/2005

OTHER PUBLICATIONS

Co-Pending U.S. Appl. No. 11/942,179, filed Nov. 19, 2007. Title: Watercraft Steering Device and Watercraft.
Co-Pending U.S. Appl. No. 11/942,159, filed Nov. 19, 2007. Title: Watercraft Steering Device and Watercraft.
Official Communication issued in corresponding European Patent Application No. 07022323.5, mailed on Apr. 19, 2011.
Official Communication issued in corresponding Japanese Patent Application No. 2006-312228, drafted on Aug. 30, 2011.

* cited by examiner

WATERCRAFT STEERING SYSTEM, AND WATERCRAFT

PRIORITY INFORMATION

The present application is based on and claims priority under 35 U.S.C. §119 to Japanese Patent Application No. 2006-312228, filed on Nov. 17, 2006, the entire contents of which are expressly incorporated by reference herein.

BACKGROUND OF THE INVENTIONS

1. Field of the Inventions

The present inventions relate to steering systems for watercraft, and more particularly, to such systems that electrically connect a steering device with an outboard motor to each other.

2. Description of the Related Art

Japanese Patent Document JP-B-2959044 describes a steering system in which an outboard motor, functioning as a watercraft propulsion unit having an internal combustion engine, a propeller (screw) mounted to a lower unit, etc. is disposed outside of a watercraft hull. A steering motor, which functions as a steering actuator for steering the outboard motor in the right and left directions, is provided in a coupling portion between the watercraft hull and the outboard motor. The steering motor and a steering wheel are connected to each other via a signal cable through which signals can be transmitted and received. The steering wheel has a rotational angle sensor. The steering motor rotates based upon a rotational direction and a rotational angle of the steering wheel detected by the rotational angle sensor to thereby steer the outboard motor.

FIG. 10 is a schematic illustration showing known relationships between steered angles of a conventional outboard motors and torques necessary for steering operations. In FIG. 10, the horizontal axis indicates steering angles ("0" represents a steering angle 0°, and the right side range relative to the position of "0" represents right directional steering angles, while the left side range relative to the position of "0" represents left directional steering angles), and the vertical axis represents magnitudes of the torque necessary for the steering operations (it is depicted that the higher the location is in FIG. 10 the larger the torque is when the outboard motor is steered rightward, and it is depicted that the lower the location is in FIG. 10 the larger the torque is when the outboard motor is steered leftward). Also, regarding the torque necessary to steer, the higher the location (the first quadrant) is in FIG. 10 the larger the torque when steered rightward (the right side range relative to the vertical axis), and it is also depicted that the lower the location (the third quadrant) is in FIG. 10 the larger the torque is when steered leftward (the left side range relative to the vertical axis). On the other hand, regarding the torque necessary to steer back, it is depicted that the lower the location (the fourth quadrant) is in FIG. 10 the larger the torque is when steered back from the right direction (the right side range relative to the vertical axis), and it is also depicted that the higher the location (the second quadrant) is in FIG. 10 the larger the torque is when steered back from the left direction (the left side range relative to the vertical axis).

As shown in FIG. 10, when the outboard motor is steered rightward from the steered angle 0° (in the situation indicated by the arrow (1) of FIG. 10) and also when the outboard motor is steered leftward from the steered angle 0° (in the situation indicated by the arrow (3) of FIG. 10), the necessary torque is the maximum at the steered angle 0°, and the larger the steered angle the smaller the necessary torque. On the other hand, when the outboard motor is steered back in the direction toward the steered angle 0° under a condition that the outboard motor has been rightward steered (in the situation indicated by the arrow (2) of FIG. 10) and also when the outboard motor is steered back in the direction toward the steered angle 0° under a condition that the outboard motor has been leftward steered (in the situation indicated by the arrow (4) of FIG. 10), the larger the steered angle the larger the necessary torque, and the smaller the steered angle the smaller the necessary torque.

SUMMARY OF THE INVENTION

An aspect of at least one of the embodiments disclosed herein includes the realization that if the watercraft turns when the watercraft is running, the water pressure is added to the outboard motor in a direction in which the outboard motor is steered. Therefore, as shown in the schematic illustration of FIG. 10, larger steering torque is necessary when the outboard motor, after it has been steered rightward or leftward, is then steered to a neutral position (the position of the steered angle 0 degree at which a fore to aft direction of the outboard motor extends along a fore to aft direction of the watercraft, also described as "steered back" in this specification) as compared to the torque required when the outboard motor is first steered in a direction in which the steered angle becomes larger either in the right direction or the left direction (described as "steered" through this specification).

Japanese Patent Document JP-B-2959044 does not disclose a mechanism for compensating for such an imbalance of the steering torque. Thus, the system of Japanese Patent Document JP-B-2959044 has a problem that the steering torque required when the outboard motor is steered back is larger than the steering torque required when the outboard motor is steered. Also, the steering torque necessary to steer the outboard motor varies in accordance with a magnitude, a direction, etc. of a propeller rotation reaction force generated by rotation of a propeller (screw) applied to the outboard motor (for example, as shown in the schematic illustration of FIG. 10, the maximum steering torque A for being steered in one direction is larger than the maximum steering torque B for being steered in the other direction). Thus, there is another problem, with the system of Japanese Patent Document JP-B-2959044 in that the operational feeling caused when the outboard motor is steered back from the particular direction is not good due to the variations noted above.

Thus, in accordance with an embodiment, a steering system for a watercraft which pivots a watercraft propulsion unit laterally relative to a hull of the watercraft, to move the propulsion unit from a neutral position to a right/left direction by driving force of a steering actuator, can comprise steering assist means for generating predetermined urging force in a direction toward the neutral position when the watercraft propulsion unit is steered toward at least one of the right direction and the left direction relative to the neutral position.

In accordance with another embodiment, a steering system for a watercraft which pivots a watercraft propulsion unit laterally relative to a hull of the watercraft between a neutral position and right and left positions with a steering actuator, can comprise a steering assist device configured to generate a predetermined force in a direction toward the neutral position when the watercraft propulsion unit is steered toward at least one of the right direction and the left direction relative to the neutral position.

DETAILED DESCRIPTION OF THE PREFERRED EMBODIMENT

The figures illustrate a steering system for a watercraft configured in accordance with certain features, aspects, and advantages of at least one of the inventions described herein. The watercraft merely exemplifies one type of environment in which the present inventions can be used. However, the various embodiments of the steering systems disclosed herein can be used with other types of watercraft or other vehicles that benefit from improved steering control. Such applications will be apparent to those of ordinary skill in the art in view of the description herein. The present inventions are not limited to the embodiments described, which include the preferred embodiments, and the terminology used herein is not intended to limit the scope of the present inventions.

Figure 1:
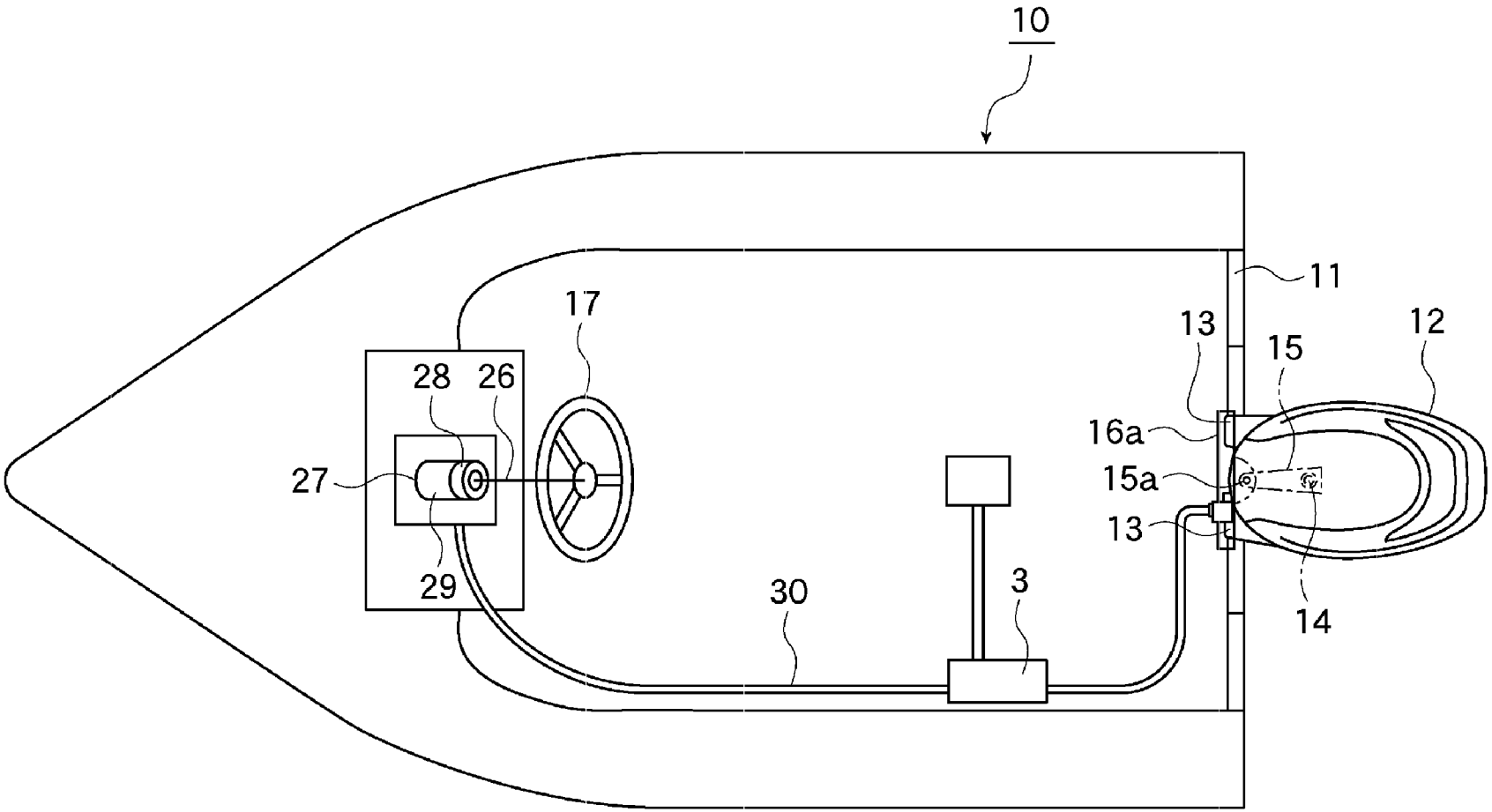
FIG. 1 is a top plan view of a watercraft according to an embodiment.

As shown in FIG. 1, in some embodiments, a watercraft can have an outboard motor 12 functioning as a "watercraft propulsion unit," mounted to a transom 11 of a watercraft hull 10 via a clamping bracket 13. The outboard motor 12 can be pivotable about an axis of a swivel shaft (steering pivot shaft) 14 extending vertically.

A steering bracket 15 can be fixed to a top end of the swivel shaft 14. A steering device 16*a* can be coupled with a front end 15*a* of the steering bracket 15. The steering device 16*a* can be operated by a steering wheel 17 disposed at a cockpit and can be driven based on the operation of the steering wheel 17.

Figure 2:
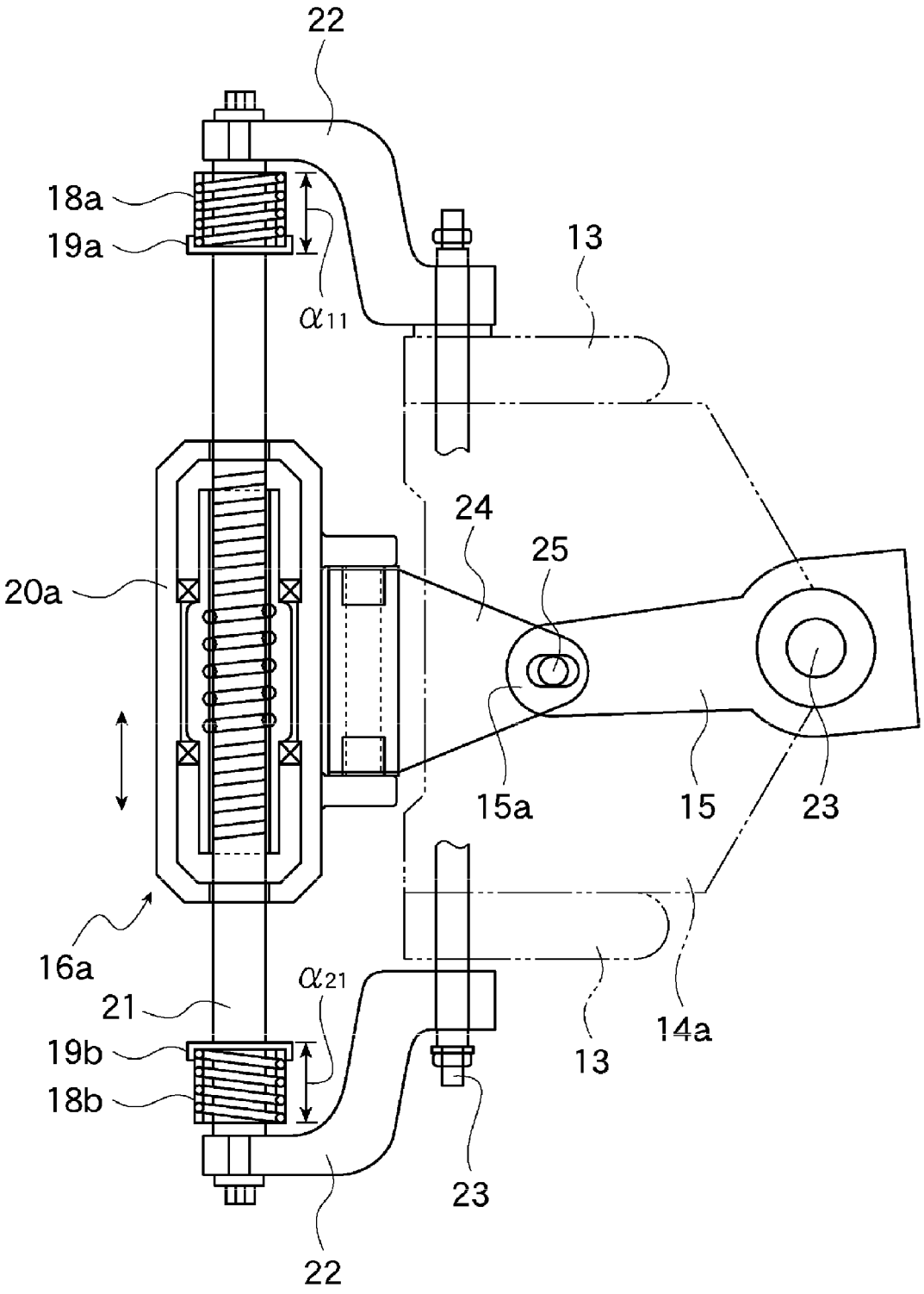
FIG. 2 is an enlarged partial cross sectional and top plan view of a steering device that can be used with the watercraft.

As shown in FIG. 2, the steering device 16*a* can have, for example, a DD (direct drive) type electric motor 20*a* functioning as a "steering actuator" as well as an "electrically operable actuator." The electric motor 20*a* can be mounted to a screw bar 21 functioning as a "shaft" extending in a right/left direction and is configured to move in the right/left direction along the screw bar 21.

The screw bar 21 can be supported at both ends thereof by supporting members 22, each of which can be one of a right and left pair of supporting members. The supporting members 22 can be supported by a tilt shaft 23.

A joint bracket 24 can extend rearwardly from the electric motor 20*a*. The joint bracket 24 and the steering bracket 15 can be coupled with each other through a coupling pin 25.

Thus, when the electric motor 20*a* operates and moves in the right/left direction relative to the screw bar 21, the outboard motor 12 pivots about the axis of the swivel shaft 14 through the joint bracket 24 and the steering bracket 15.

Springs 18*a*, 18*b*, which can function respectively as "steering assist means" and "urging means", can be placed at the respective ends of the screw bar 21. Each spring 18*a*, 18*b* can be a coil spring whose inner diameter can be slightly larger than the screw bar 21, and can be interposed between an end of the respective supporting member 22 and a circular stopper 19*a*, 19*b* placed adjacent to the respective end of the screw bar 21. Because the "steering assist means" and the "urging means" are formed with the mechanical structures such as the springs 18*a*, 18*b*, the assist force can be applied to the electric motor 20*a* with a more simple construction. However, other configurations and devices can be used as the "steering assist means" and "urging means".

The configurations, and thus the resilient force, of the springs 18*a*, 18*b* can be chosen in such a manner that the one placed on a side where the propeller rotation reaction force is generated when the outboard motor 12 is steered back is large, is greater than the other placed on the opposite side where the propeller rotation reaction force is small.

A magnitude of the resilient force of each spring 18*a*, 18*b* can also be decided based upon a steering torque amount required by the electric motor 20*a*. For example, the resilient force of the spring (herein, the spring 18*a*) placed on the side where the propeller rotation reaction force generated when the outboard motor is steered back is large is greater than the spring (herein, the spring 18*b*) placed on the other side where the propeller rotation reaction force generated when the outboard motor is steered back is small by an amount which is resulted when the maximum steering torque of one side is subtracted from the maximum steering torque of the other side (for example, in FIG. 4, by an amount which is resulted when the maximum steering torque of one side B is subtracted from the maximum steering torque of the other side A). As thus set, the imbalance of the steering torque of the electric motor 20*a* is improved.

Further, the resilient force of each spring 18*a*, 18*b* can also be decided based upon physical amounts such as, weights of the outboard motor 12 and the watercraft hull 10, affecting the steering torque of the electric motor 20*a* when the outboard motor 12 is steered. Specifically, the larger the weights of the outboard motor 12 and the watercraft hull 10 are, the larger the resilient force of the springs 18*a*, 18*b* can be set.

Additionally, in some embodiments applied to a watercraft having a plurality of outboard motors 12 mounted on the watercraft hull 10, set positions of the respective outboard motors relative to the watercraft hull can be used as one of the physical amounts that are bases for the resilient setting of the springs 18*a*, 18*b*. For example, if the respective outboard motors are placed near the center of the transom 11, the resilient force of each spring 18*a*, 18*b* can be set to be smaller. On the other hand, if the respective outboard motors are placed near the outer ends of the transom 11, the resilient force of each spring 18*a*, 18*b* can be set to be larger.

As shown in FIG. 1, the steering wheel 17 can be fixed to a steering shaft 26. A steering wheel control section 27 can be disposed at a bottom end of the steering shaft 26. The steering wheel control section 27 can have a steering wheel operation angle sensor 28 which can be configured to detect an operation angle of the steering wheel 17 and a reaction motor 29 which can be configured to apply a desired reaction force to the steering wheel 17 when the steering wheel 17 is operated.

A system can be constructed in such a manner that the steering wheel section 27 can be connected to a control unit (ECU: engine control unit) 31 through a signal cable 30, the control unit 31 can be connected to the electric motor 20*a* of the steering device 16*a*. A signal from the steering wheel operation angle sensor 28 can be input into the control unit 31, and the control unit 31 can control and drive the electric motor 20*a* and can also control the reaction motor 29.

Detection signals indicative of a steering condition of the steering wheel 17, a steered condition of the outboard motor 12, a running condition of the watercraft hull 10, etc. can be supplied to the control unit 31 from various detecting devices 32 provided to portions of the watercraft hull 10 and the outboard motor 12. The various detecting devices 32 can include, for example, but without limitation, a torque sensor configured to detect a steering torque sufficient for steering the outboard motor in accordance with an operation of the steering wheel, an outboard motor steered angle sensor configured to detect present steered angle, steered speed, steered direction of the outboard motor 12, deviation detecting device configured to detect steered angle deviation in accordance with the operation of the steering wheel, weight detecting device configured to detect the waterline and weight of the watercraft, a trim angle sensor configured to detect a trim angle of the watercraft, a speed sensor configured to detect speed, acceleration, thrust of the watercraft, an output of the outboard motor, and so forth.

Figure 3:
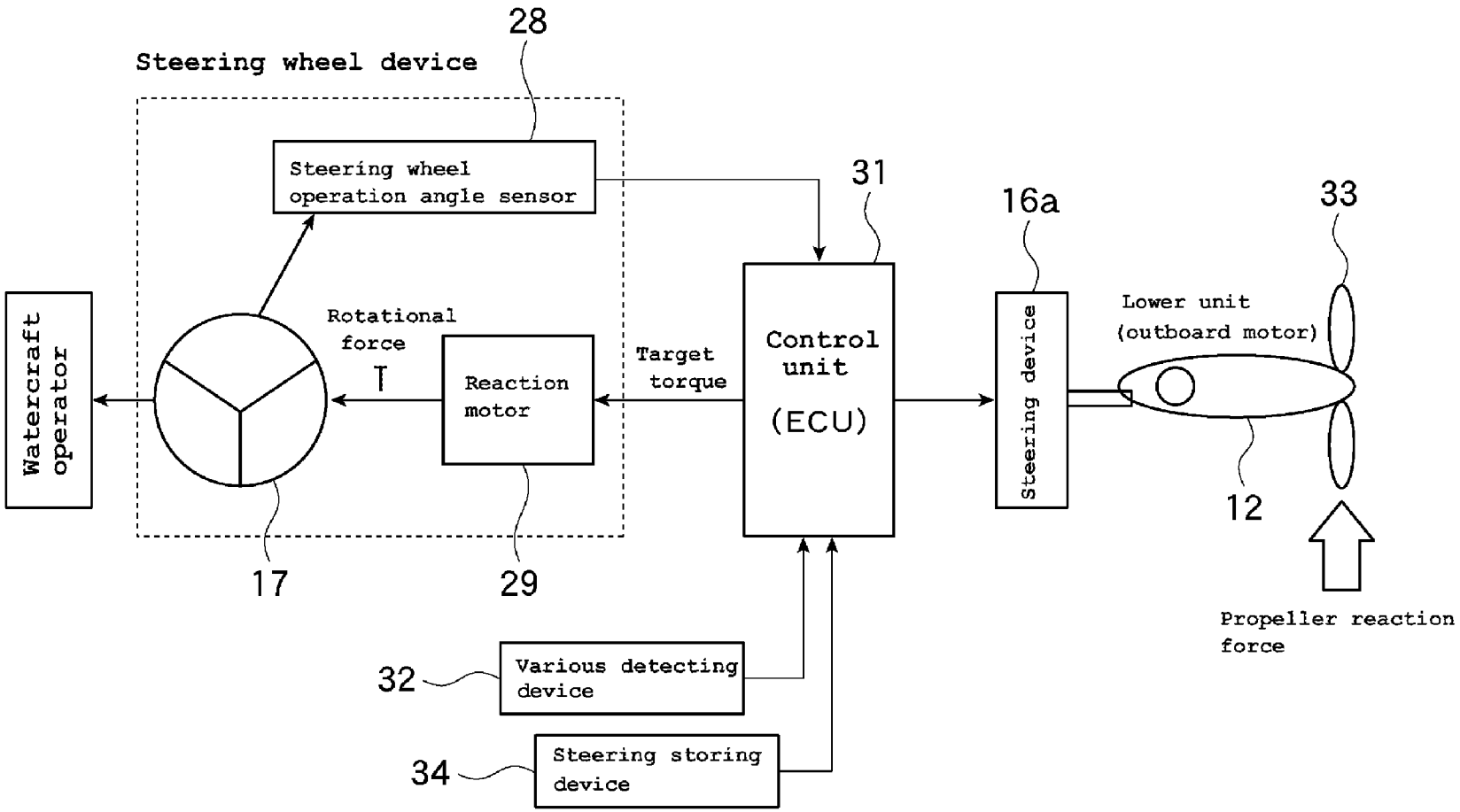
FIG. 3 is a functional block diagram of a control system that can be used with the watercraft.

Further, a steering storing device 34 can be configured to store information about the number of outboard motors 12, mount positions of the outboard motors 12 relative to the watercraft and rotational directions of the propeller 33 provided to each outboard motor 12 (see FIG. 3). Additionally, the steering storing device 34 can be configured to output the information based upon requests of the control unit 31. In some embodiments, the steering storing device 34 can be built in the control unit 31.

During operation, when the steering wheel 17 is pivoted by a preset amount by a watercraft operator, detection signals of the steering wheel operation angle sensor 28 and the various detecting devices 32 are transmitted to the control unit 31. Further, detection signals and various signals are transmitted to the control unit 31 from the various detecting devices 32. The control unit 31 calculates steering torque sufficient for steering the outboard motor 12 and a steering angle, steering speed, steering direction, etc. of the steering in accordance with the steering wheel operation based upon those detection signals and various pieces of information and also various pieces of information stored in the steering storing means 34. The control unit 31 thus rotates the electric motor 20*a* based upon those signals and the calculation results. When the electric motor 20*a* rotates, the motor 20*a* moves in the right/left direction along the screw bar 21, and the outboard motor 12 pivots about the axis of the swivel shaft 14 to change its direction.

For example, the following description applies to a situation in which the outboard motor 12 is fully steered leftward (lower side of FIG. 2). When the steering wheel 17 is operated counterclockwise, the electric motor 20*a* pivots in one direction and moves rightward on the screw bar 21 (toward upper side of FIG. 2) to the vicinity of the right end of the screw bar 21. When the electric motor 20*a* reaches the right end of the screw bar 21, an end portion of the electric motor 20*a* presses the spring 18*a* in a contacting zone α11 where the electric motor 20*a* and the stopper 19*a* contact with each other.

When, under this condition, the steering wheel 17 is operated clockwise to steer back the outboard motor, the electric motor 20*a* pivots in the other direction. The resilient force of the spring 18*a* is added to the electric motor 20*a* as the electric motor 20*a* moves through the contacting zone α11. The electric motor 20*a* thus moves toward the center on the screw bar 21 by the resilient force of the spring 18*a* in addition to the rotational force of its own. On the other hand, when the outboard motor 12 is steered back after being fully steered rightward, the electric motor 20*a* moves on the screw bar 21 in the contacting zone α21 toward the center by the resilient force of the spring 18*b* in addition to the rotational force of its own.

As discussed above, in some embodiments, the springs 18*a*, 18*b* pressing the electric motor 20*a* in the axial direction of the screw bar 21 can be provided at the ends of the screw bar 21. As such, the electric motor 20*a* is moved in the right/left direction along the screw bar 21 to steer the outboard motor 12. In this construction, the assist force can be applied to the electric motor 20*a* with a more simple structure.

Also, in some embodiments, when the electric motor 20*a* is in the contacting zone α11, i.e., when the steered angle of the outboard motor 12 is in a predetermined angular range including the maximum steered angle, the springs 18*a*, 18*b* can assist the steering torque of the electric motor 20*a* by applying the assist force to the electric motor 20*a* at a time that the steering torque amount necessary for steering back the outboard motor 12 is the maximum or almost the maximum.

Also, in some embodiments, either one of the springs 18*a*, 18*b* can apply the assist force on the side where the propeller rotation reaction force generated when the outboard motor 12 is steered back is large; thereby, the spring 18*a*, 18*b* can assist the steering torque of the electric motor 20*a* in the steering direction in which the steering torque necessary for steering back the outboard motor 12 is the maximum.

Also, in some embodiments, the assist force of the springs 18*a*, 18*b* can be decided based upon the steering torque applied when the outboard motor 12 is steered back, and the respective weights of the watercraft hull 10 and the outboard motor 12 provided as the physical amounts affecting the steering torque. Therefore, the resilient force of the springs 18*a*, 18*b* can be decided in a manner such that proper assist force is applied to the electric motor 20*a*.

Figure 4:
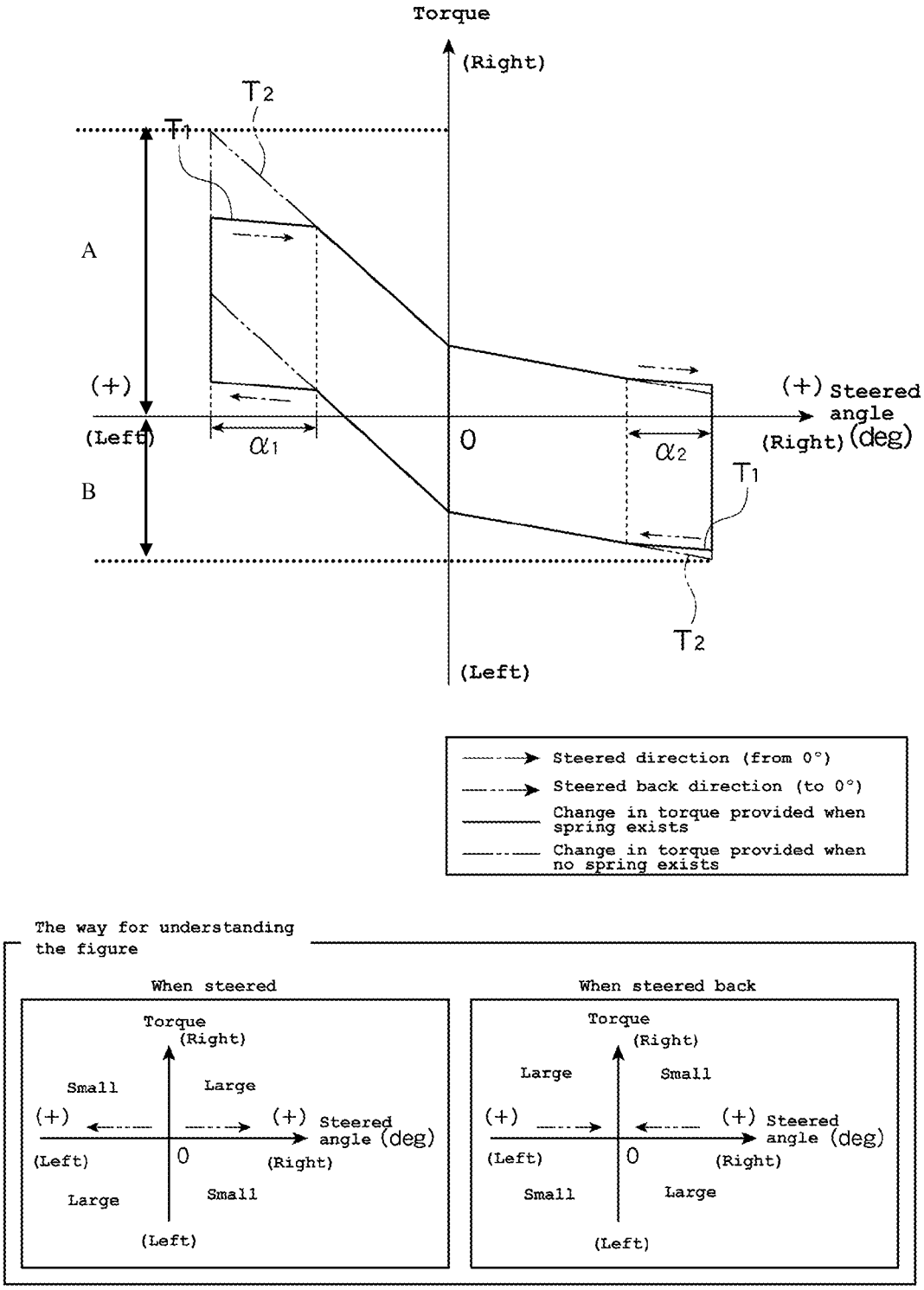
FIG. 4 is a schematic illustration showing exemplary relationships between steered angles of an outboard motor and torque for steering operations thereof, that can be used with the watercraft.
Figure 10:
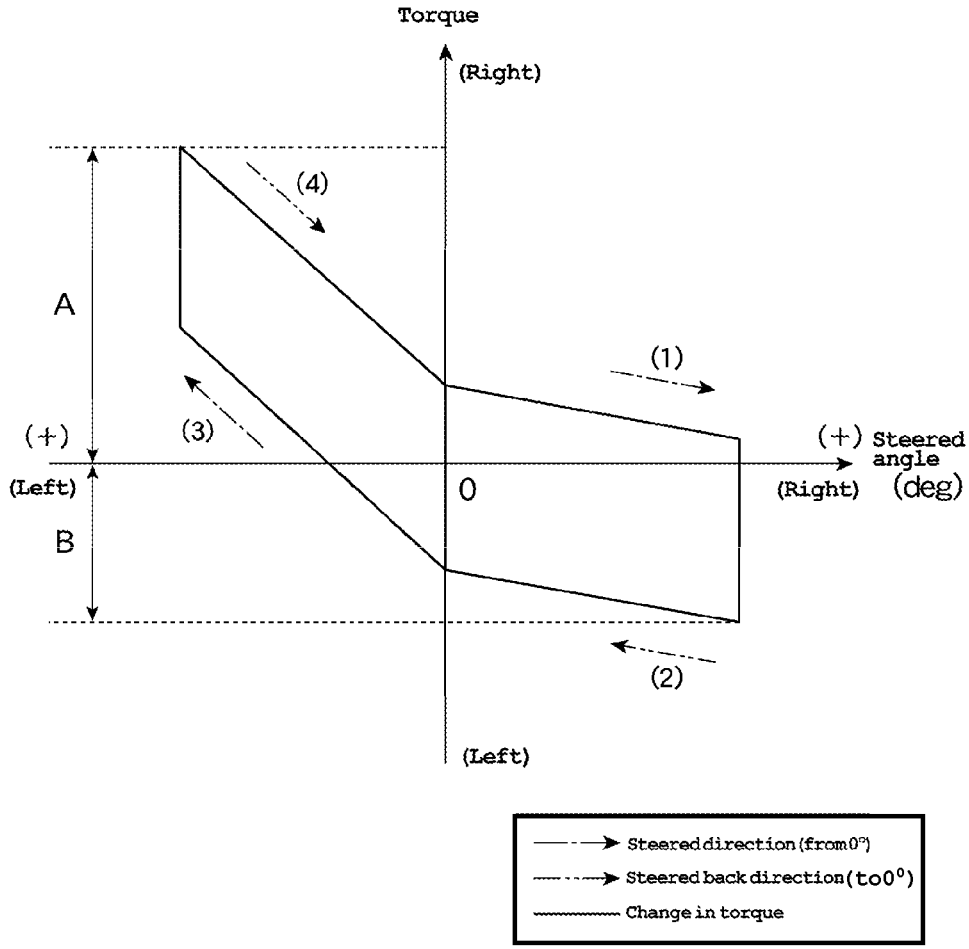
FIG. 10 is a schematic illustration showing relationships between steered angles of a conventional outboard motor and torque necessary for steering operations thereof.
Figure 10:
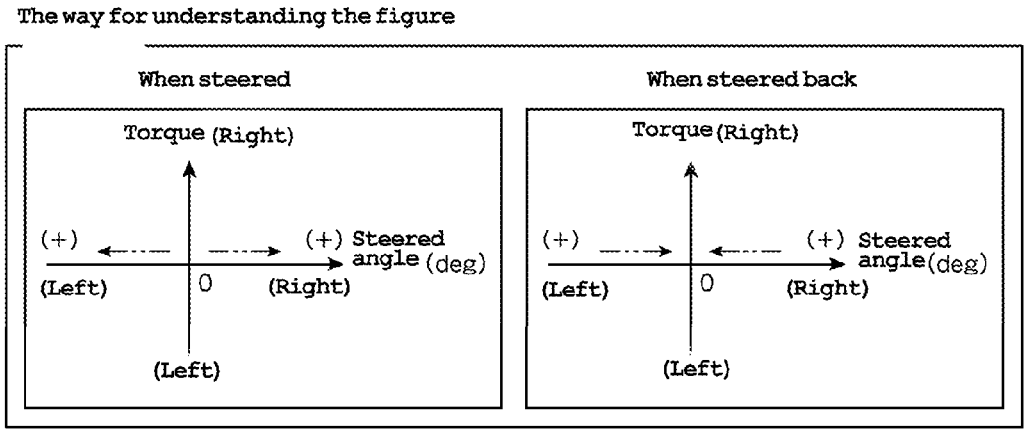

FIG. 4 is a schematic illustration showing exemplary relationships between steered angles of the outboard motor 12 and torques sufficient for steering operations in some embodiments. This figure is, in its layout, is similar to the schematic illustration of FIG. 10 described above.

As shown in FIG. 4, in the situation that the outboard motor 12 that has been steered in the right/left direction is steered back, the imbalance appearing between the steering torque applied when the outboard motor is steered back from one side and the steering torque applied when the outboard motor is steered back from the other side can be corrected.

In some embodiments, the load added to the electric motor 20*a* when the outboard motor 12 is steered back can be decreased. For example, as shown in the schematic illustration of FIG. 4, the assist force of the respective springs 18*a*, 18*b* can be added to the electric motor 20*a* over an angle of rotation α1 in the contacting zone α11 (FIG. 2) and over an angle of rotation α2 in the contacting zone α21 (FIG. 2). As a result, a torque value T1 applied when the outboard motor is steered back decreases more than a torque value T2 applied when the outboard motor is steered back without the assist force. Thereby, the feeling of steering operations can be improved when the watercraft propulsion unit, that has previously been steered in the right/left direction, is steered back to the neutral position.

Additionally, in some embodiments, the structure in which the springs 18*a*, 18*b* are provided at both of the ends of the screw bar 21 can be employed. Alternatively, another structure can be employed in which a spring is provided only at one of the ends on the side where the propeller rotation reaction force generated when the outboard motor 12 is steered back is large.

Figure 5:
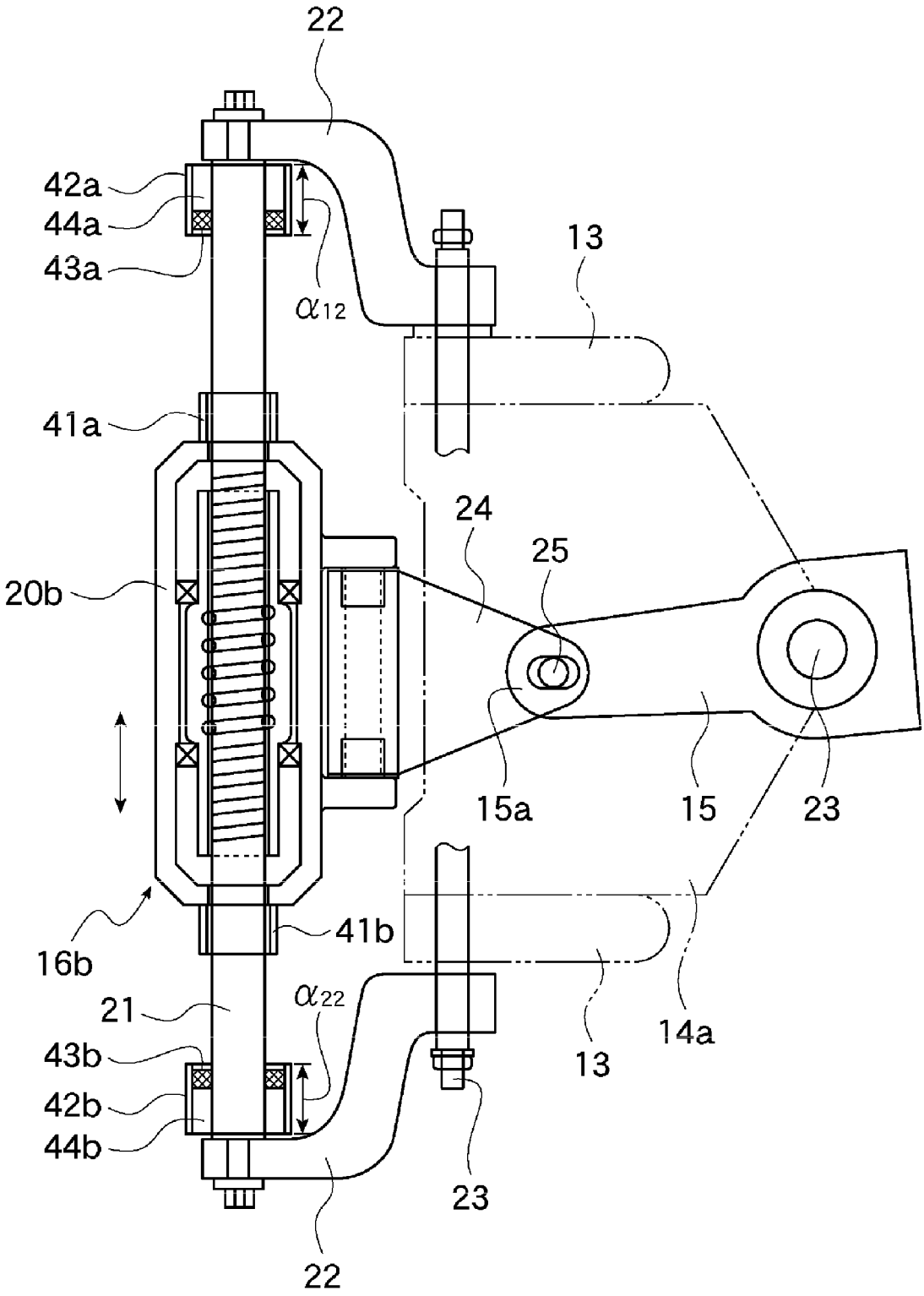
FIG. 5 is an enlarged partial cross sectional and top plan view of another steering device that can be used with the watercraft.

For example, as shown in FIG. 5, a steering device 16*b* can replace the steering device 16*a* of FIG. 1-3. As shown in FIG. 5, the electric motor 20*b* of the steering device 16*b* can have pressing projections 41*a*, 41*b* at both ends. Each pressing projection 41*a*, 41*b* can have a generally cylindrical shape whose inner diameter can be slightly larger than an outer diameter of the screw bar 21 and can be disposed over the screw bar 21.

Also, in some embodiments, an end of each supporting member 22 can have a cylinder 42*a*, 42*b*. A piston 43*a*, 43*b* can be disposed in each cylinder 42*a*, 42*b*. The cylinder 42*a*, 42*b* and the piston 43*a*, 43*b* together can be considered as forming an "urging member".

Each cylinder 42*a*, 42*b* can have a generally cylindrical shape whose inner diameter can be larger than the outer diameter of the screw bar 21, and can extend inwardly in a configuration such that an axial direction thereof extends along the axial direction of the screw bar 21. Each piston 43*a*, 43*b* can be formed circularly in such a manner that an inner diameter thereof can be generally equal to the outer diameter of the screw bar 21 and an outer diameter thereof can be generally equal to the inner diameter of the cylinder 42*a*, 42*b*. Each piston 43*a*, 43*b* can be slidable inside of the associated cylinder 42*a*, 42*b* in the axial direction of the cylinder 42*a*, 42*b* and the screw bar 21. Because, in some embodiments, the "urging means" can be formed with the mechanical structures, such as the cylinders 42*a*, 42*b* and the pistons 43*a*, 43*b*, the assist force can be applied to the electric motor 20*b* with a more simple construction. However, other constructions can also be used.

The inside of each cylinder 42*a*, 42*b* can be formed as an air space 44*a*, 44*b*. Each air space 44*a*, 44*b* can enclose a gas whose pressure can be higher than the atmospheric pressure, such as compressed air. However, other gases and fluids can also be used.

A pressure of the air enclosed in the air space 44*a*, 44*b* can be set based upon the steering torque amounts applied by the electric motor 20*b*, similarly to the resilient force of each spring 18*a*, 18*b* in the embodiments described with reference to FIGS. 1-3. For example, the air pressure of the air space (herein, the air space 44*a*) in the cylinder (herein, the cylinder 42*a*) placed on the side where the propeller rotation reaction force generated when the outboard motor can be steered back is large is greater than the pressure in the air space (herein, the air space 44*b*) in the cylinder (herein, the cylinder 42*b*) placed on the other side where the propeller rotation reaction force generated when the outboard motor is steered back is small by an amount which is resulted when the maximum steering torque of one side is subtracted from the maximum steering torque of the other side (for example, by an amount which is resulted when the maximum steering torque of one side B is subtracted from the maximum steering torque of the other side A, shown in FIG. 4). As such, the imbalance of the steering torque of the electric motor 20*a* can be better corrected.

Further, the air pressure of each air space can be set based upon physical amounts affecting the steering torque of the electric motor 20*b* when the outboard motor 12 is steered, such as the weights of the outboard motor 12 and the watercraft hull 10.

The construction of the other components of the steering device 16*b* can be the same or similar to those of the steering device 16*a*, and thus, their description is not repeated herein.

During operation of the steering device 16*b*, when the steering wheel 17 is rotated and the electric motor 20*b* rotates under control of the control unit 31 to move in the right/left direction along the screw bar 21, the outboard motor 12 pivots about the axis of the swivel shaft 14 to change its direction.

Similar to the above description of the behavior of the steering device 16*a*, for example, a situation in which the outboard motor 12 is fully steered leftward (lower side of FIG. 5) is described below, with regard to the steering device 16*b*. When the steering wheel 17 is turned counterclockwise and the electric motor 20*a* moves rightward on the screw bar 21 to the vicinity of the right end of the screw bar 21, the pressing projection 41*a* is inserted into the cylinder 42*a*, and the pressing projection 41*a* contacts with the cylinder 42*a* and presses the cylinder 42*a* toward the end of the screw bar 21. When, under this condition, the steering wheel 12 is then operated clockwise, the electric motor 20*b* starts to move toward the center. At this time, in the contacting zone $\alpha$12 in which the pressing projection 41*a* and the cylinder 42*a* contact with each other, the resilient force based upon the air pressure in the air space 44*a* is added to the electric motor 20*b* through the piston 43*a*. Then, when the electric motor 20*b* placed in the vicinity of the end of the screw bar 21 is returned to the center (i.e., when the outboard motor 12 is returned to the neutral position, starting from the condition under which the outboard motor has been steered to the maximum steered angle), the electric motor 20*b* moves through the contacting zone $\alpha$12 toward the center on the screw bar 21 by the resilient force of the piston 43*a* in addition to the rotational force of its own. Similarly, in the contacting zone $\alpha$12 on the other side of the screw bar 21, the electric motor 20*b* moves on the screw bar 21 toward the center by the resilient force of the piston 43*b* in addition to the rotational force of its own.

The steering device 16*b* also provides the same or similar actions as those of the steering device 16*a* in that it decreases the load of the electric motor 20*b* generated when the outboard motor 12 is steered back, and the feeling of steering operations can be improved when the watercraft propulsion unit, which that has previously been steered in the right/left direction, is steered back to the neutral position.

Figure 6:
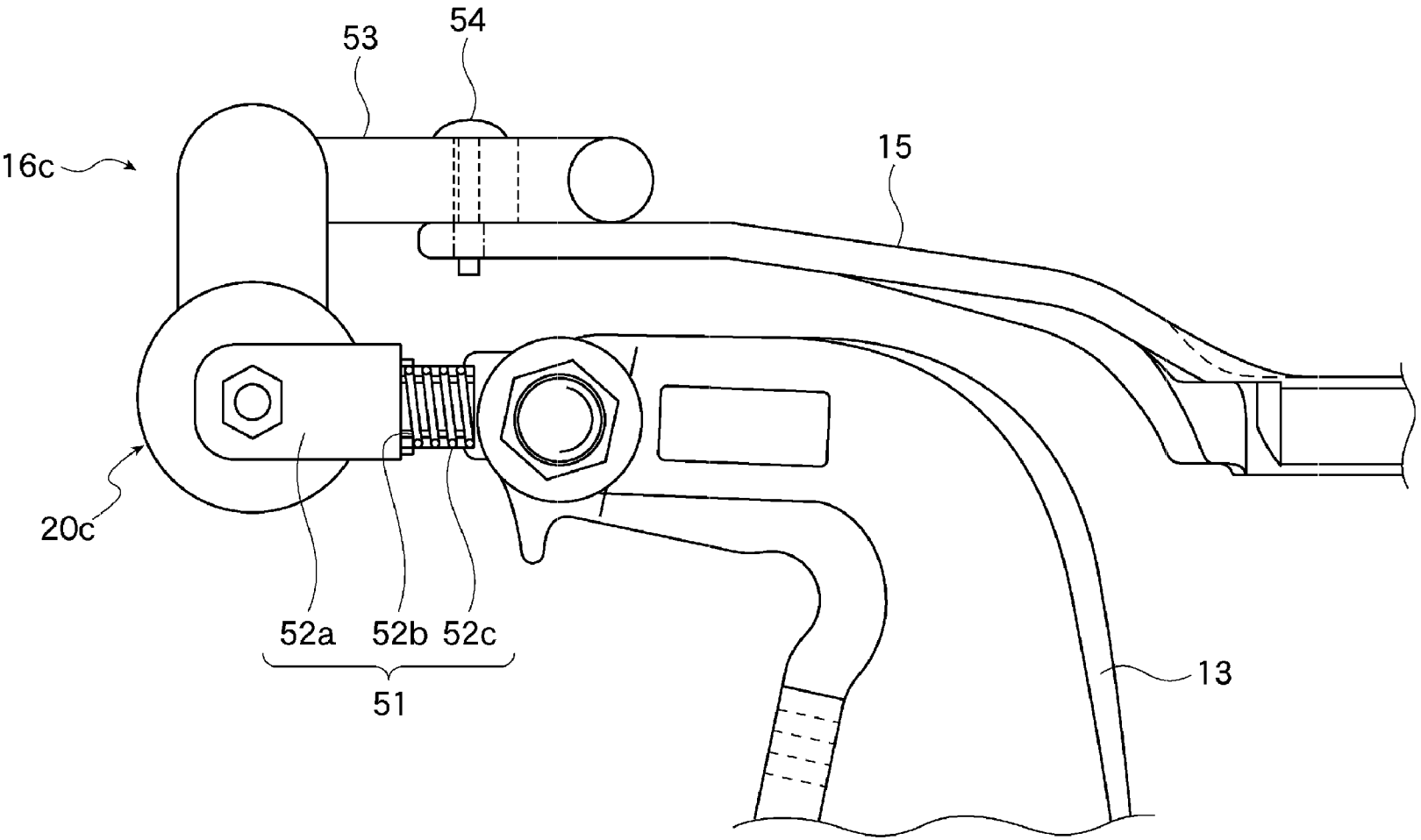
FIG. 6 is an enlarged side elevational view of another steering device that can be used with the watercraft.

With reference to FIG. 6, in some embodiments, a steering device 16*c* can replace the steering devices 16*a* or 16*b* described above. In the steering device 16*c*, an electric motor 20*c* can replace the electric motor 20*a*. Additionally, a pair of supporting members 51, which can function as "urging means" can replace the pair of supporting members 22 supporting the screw bar 21 in the steering devices 16*a*, 16*b*.

Each supporting member 51 can include a coupling body 52*a*, a generally cylindrically-shaped post 52*b* and a spring 52*c* positioned around the post 52*b*. The post 52*b* can be retractably formed because of being inserted into and drawn out from the interior of the coupling body 52*a* in the fore to aft direction (right/left direction in FIG. 6). One end of the coupling bracket 53 can be coupled with a top portion of the electric motor 20*c*, while the other end of the coupling bracket 53 is coupled with the steering bracket 15 through a connecting pin 54. The construction of the other components of the steering device 16*c* can be the same or similar to those of the steering device 16*a*, 16*b*, and thus, their description is not repeated herein.

During operation, when the steering wheel 17 is rotated and the electric motor 20*c* rotates under control of the control unit 31 to move in the right/left direction along the screw bar 21, the outboard motor 12 pivots about the axis of the swivel shaft 14 to change its direction. The screw bar 21 and the clamping bracket 13 are urged away from each other by the urging force of the spring 52*c*, e.g., in a direction in which the screw bar 21 and the clamping bracket 13 are separated from each other.

Thus, the closer the electric motor 20*c* approaches the end of the screw bar 21, the longer the posts 52*b* of the respective supporting members 51 extend in the fore to aft direction. As a result, a distance from the electric motor 20*c* to the axis of the swivel bracket 14 (not shown in FIG. 6) that is the pivot center when the outboard motor is steered becomes farther. Accordingly, the larger the steered angle of the outboard motor 12 is, the farther the distance from the pivot center is at which the electric motor 20*c* applies the pivot force to the steering bracket 15. In other words, the larger the steered angle of the outboard motor 12 is, the lower the load that is instantly added to the electric motor reduces. The steering torque of the electric motor 20*c* required when the outboard motor is steered back decreases.

Figure 7:
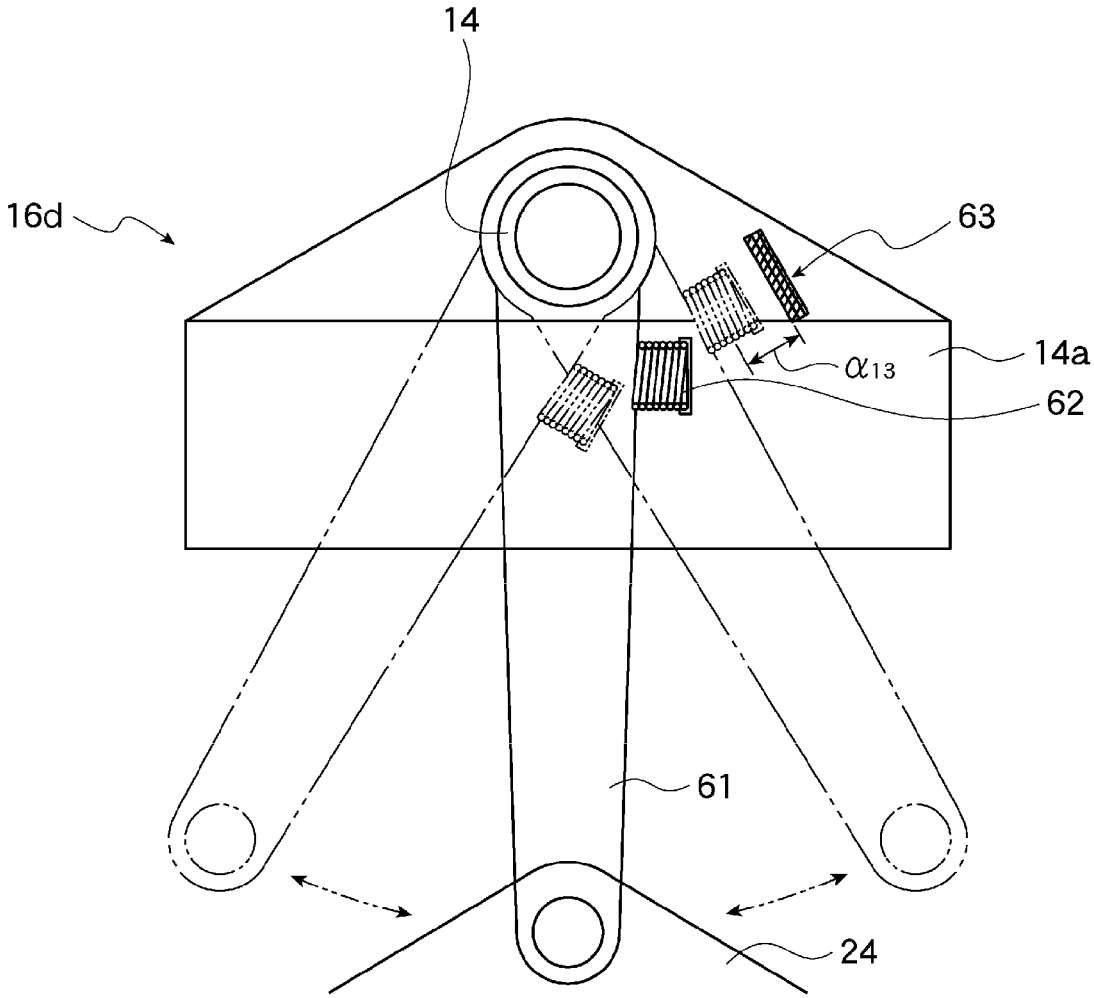
FIG. 7 is an enlarged top plan view of a portion of yet another steering device that can be used with the watercraft.

With reference to FIG. 7, in some embodiments, a steering device 16*d* can replace the steering device 16*a*, 16*b*, or 16*c*. In the steering device 16*d*, a steering bracket 61 replaces the steering bracket 15. The steering bracket 61 can have a spring 62 which can serve as "urging means" positioned at one side thereof that is the side where the propeller rotation reaction force generated when the outboard motor 12 is steered back is larger than that on the other side. The spring 62 can be a coil spring, and one end thereof can be fastened to the steering bracket 61. Also, the swivel bracket 14*a* disposed below the steering bracket 61 can have a stopper 63 projecting at a position where the spring 62 touches the stopper 63 when the steering bracket 61 fully pivots.

The resilient force of the spring 62 can be set based upon the steering torque amount required from the electric motor 20*a* (not shown in FIG. 7). For example, the resilient force of the spring 62 can be set to be a magnitude which results when the maximum steering torque of one side is subtracted from the maximum steering torque of the other side (for example, in FIG. 4, a magnitude which is resulted when the maximum steering torque of one side B is subtracted from the maximum steering torque of the other side A). The construction of the other components of the steering device 16*d* can be the same or similar to those of the steering device 16*a*, 16*b*, 16*c*, and thus, their description is not repeated herein.

During operation, assuming that the outboard motor 12 is fully steered to the other side (right side in FIG. 7), when the steering wheel 17 is rotated in the other direction, the electric motor 20*a* rotates in one direction (left side in FIG. 7) and moves leftward on the screw bar 21 to reach the vicinity of the left end of the screw bar 21. On this occasion, the stopper 63 touches the spring 62 and the resilient force of the spring 62 is added to the stopper 63 in a contacting zone α13 where the stopper 63 and the spring 62 contact with each other. Then, when the electric motor 20*a* placed in the vicinity of the left end of the screw bar 21 is returned to the center (i.e., when the outboard motor 12 is returned to the center, starting from the condition under which the outboard motor has been steered to the maximum steered angle), the electric motor 20*a* moves in the contacting zone α13 toward the center on the screw bar 21 by the resilient force of the spring 62 in addition to the rotational force of its own.

As discussed above, in this embodiment, the load to the electric motor 20*a* added when the outboard motor 12 is steered back can decrease without a special structure for directly pressing the electric motor 20*a* being provided, and the feeling of steering operations can be improved when the watercraft propulsion unit that has been steered in the right/left direction is steered back to the neutral position.

Additionally, in some embodiments described above, the spring 62 and the stopper 63 can be placed on the one side where the steering torque for steering the outboard motor becomes large. However, the spring and the stopper can be placed on the other side to reduce the load added to the electric motor 20*a* when the steering torque of both of the sides becomes the maximum.

Figure 8:
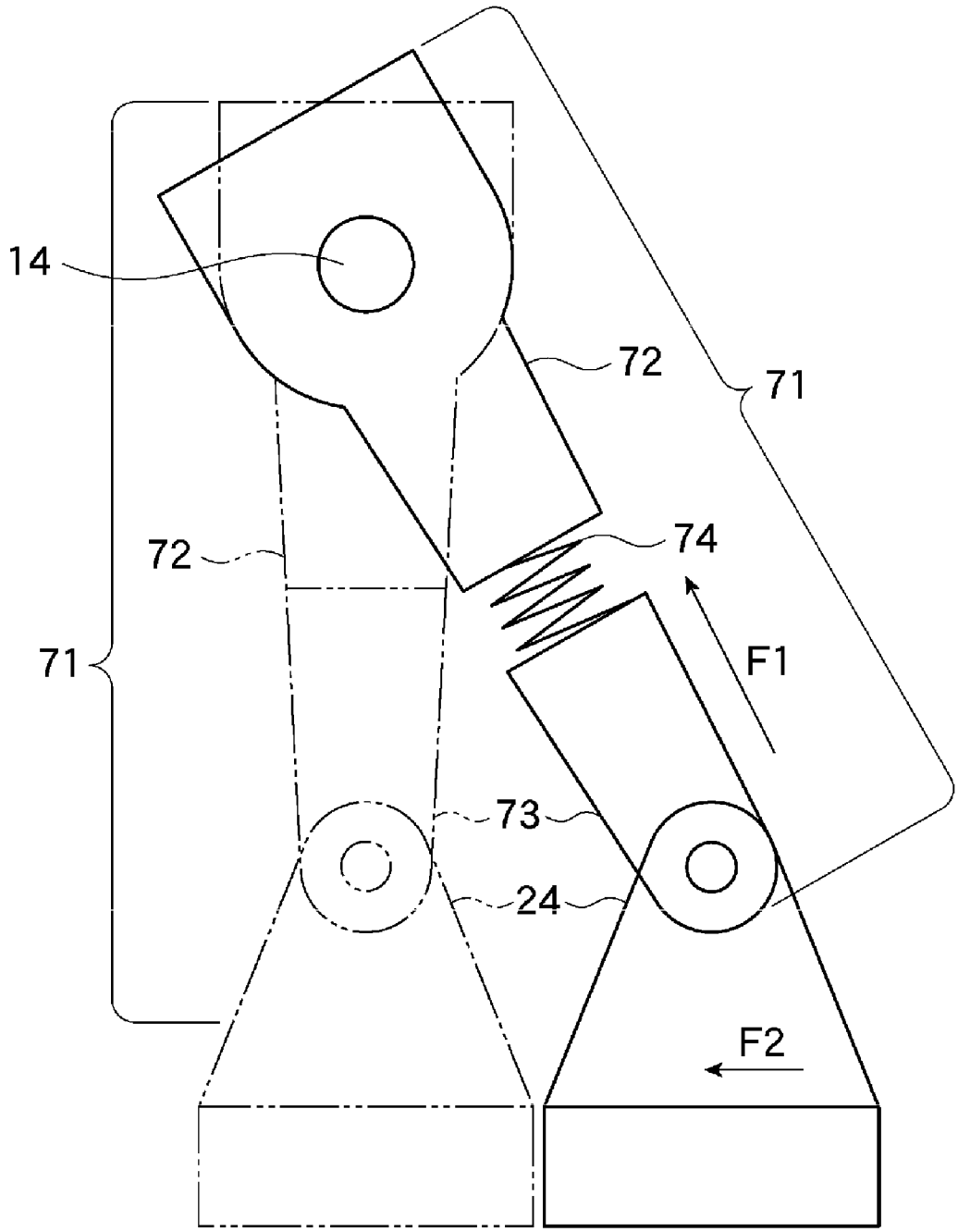
FIG. 8 is an enlarged top plan view of a portion of a further steering device that can be used with the watercraft.

With reference to FIG. 8, in some embodiments, a steering bracket 71 can replace the steering bracket 15. The steering bracket 71 can have a structure in which one end of a first member 72 provided on the swivel shaft side and one end of a second member 73 provided on the joint bracket 24 side are coupled with each other by a spring 74, which can serve as "urging means".

The spring 74 can be a coil spring, can provide high resilient force and can also provide high urging force in its returning direction against pulling force pulling the first member 72 and the second member 73 in a direction in which those members are separated from each other. Additionally, if having substantially the same functions, springs other than the coil spring or resilient members other than those springs can be employed for forming the "urging means". The construction of the other components of an associated steering device can be the same or similar to those of the steering device 16*a*, 16*b*, 16*c*, 16*d*, and thus, their description is not repeated herein.

During operation, when the steering wheel 17 is rotated and the electric motor 20*a* (not shown in FIG. 8) rotates under control of the control unit 31 to move in the right/left direction along the screw bar 21 (not shown in FIG. 8), the outboard motor 12 pivots about the axis of the swivel shaft 14 to change its direction. Thus, the pulling force pulling the first member 72 and the second member 73 in a direction in which those members are separated from each other is added to the steering bracket 71 existing between the electric motor 20*a* and the swivel shaft 14. The spring 74 is extended by the pulling force. Thereby, the spring 74 generates the urging force.

By the urging force, force F1 affects the second member 73 in the same direction as the pulling force (obliquely left and upper direction in FIG. 8). The force F1 acts as a component of force F2 heading to the center of the screw bar 21 with regard to the electric motor 20*a* mounted to the screw bar 21. Accordingly, if the outboard motor is steered back after being steered, the electric motor 20*a* is moved on the screw bar 21 toward the center by the component of force F2 in addition to the rotational force of its own.

As discussed above, in some embodiments, the coil spring 74 extending and contracting the steering bracket 71 in the axial direction thereof can be provided, an thus, in the structure that the electric motor 20*a* is moved in the right/left direction along the screw bar 21 to steer the outboard motor 12, the assist force can be applied to the electric motor 20*a* with a more simple construction.

Figure 9:
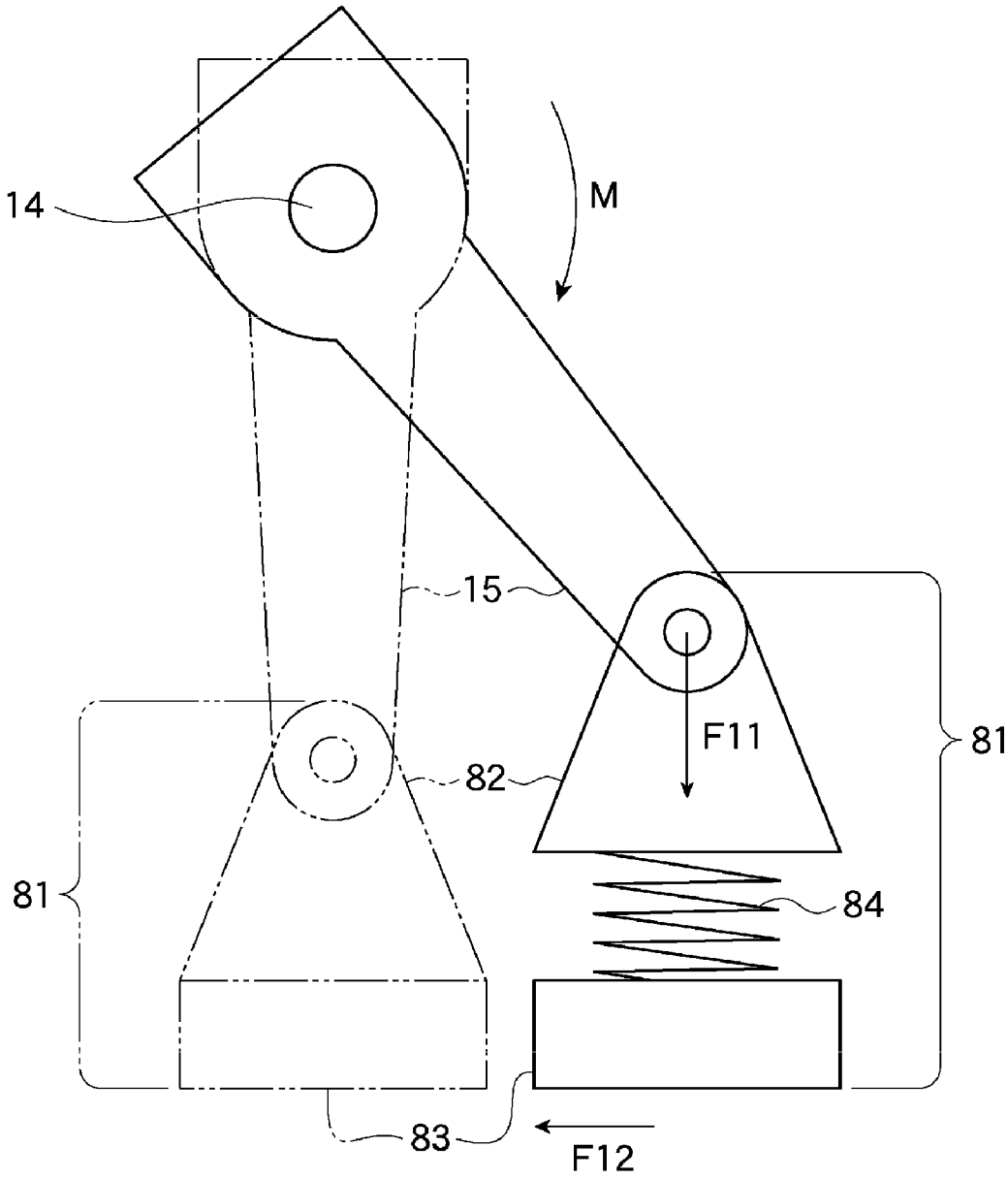
FIG. 9 is an enlarged top plan view of a portion of a yet another steering device that can be used with the watercraft.

With reference to FIG. 9, in some embodiments, a joint bracket 81 can replace the joint brackets 24 described above with reference to the other steering devices 16*a*, 16*b*, 16*c*, and 16*d*. The joint bracket 81 can have a structure in which one end of a first member 82 provided on the steering bracket 15 side and one end of a second member 83 provided on the electric motor 20*a* (not shown in FIG. 9) side are coupled with each other by a spring 84, which can function as an "urging means".

The spring 84 can be a coil spring, and can provide high resilient force and also provides high urging force in its returning direction against pulling force pulling the first member 82 and the second member 83 in a direction in which those members are separated from each other. Additionally, if having the same functions, springs other than the coil spring or resilient members other than those springs can be employed for forming the "urging means." The construction of the other components of an associated steering device can be the same or similar to those of the steering device 16*a*, 16*b*, 16*c*, 16*d*, and thus, their description is not repeated herein.

During operation, when the steering wheel 17 is rotated and the electric motor 20*a* rotates under control of the control unit 31 to move in the right/left direction along the screw bar 21 (not shown in FIG. 9), the outboard motor 12 pivots about the axis of the swivel shaft 14 to change its direction. At this time, the pulling force pulling the first member 82 and the second member 83 in a direction such that those members are separated from each other is added to the joint bracket 81 existing between the electric motor 20*a* and the swivel shaft 14. The spring 84 is extended by the pulling force. Thereby, the spring 84 generates the urging force. By the urging force, force F11 affects the first member 82 in the opposite direction against the pulling force (lower direction in FIG. 9). The force F11 acts as a moment M which pivots about the axis of the swivel shaft 14 in a direction in which the outboard motor is steered back (lower direction in FIG. 9) in the steering bracket 15. The moment acts as a component of force F12 heading to the center of the screw bar with regard to the electric motor 20*a*. Accordingly, if the outboard motor is steered back after being steered, the electric motor 20*a* is moved on the screw bar 21 toward the center by the component of force F12 in addition to the rotational force of its own.

As discussed above, in some embodiments, the coil spring 84 extending and contracting the joint bracket 81 in the axial direction thereof is provided, and thus, in the structure that the electric motor 20*a* is moved in the right/left direction along the screw bar 21 to steer the outboard motor 12, the assist force can be applied to the electric motor 20*a* with a more simple construction.

Although the devices described above which can serve as an "urging means" are formed springs or cylinders with pistons, torsion springs can also be employed for forming the urging means. However, other devices can also be used.

In some of the embodiments discussed above, the structures reducing the load added to the steering motors 20*a*, 20*b*, 20*c* are provided each by each. However, combinations of two or more structures provided in the respective embodiments can also be applicable to further reduce the load added to the electric motor 20*a*, 20*b*, 20*c*.

In some of the embodiments discussed above, the "steering actuator" can be formed with the electric motors 20*a*, 20*b*, 20*c*, and can serve as "electrically operable actuators". However, the "steering actuator" is not limited to the electric motor and can be formed with any type of actuator driven by electric power or power other than the electric power.

In some of the embodiments discussed above, the "shaft" on which the electric motor 20*a*, 20*b*, 20*c* is provided is formed with the screw bar 21. However, a "shaft" other than the screw bar 21 can be used for providing the "steering actuator."

Although the outboard motor 12 is applied as the "watercraft propulsion device" in some of the embodiments discussed above, the "watercraft propulsion device" is not limited to the outboard motor and an inboard and outboard unit is of course applicable.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments can be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A steering system for a watercraft arranged to pivot a watercraft propulsion unit laterally relative to a hull of the watercraft, to move the propulsion unit from a neutral position in right and left directions by a driving force of a steering actuator, the steering system comprising:

a steering assist device to generate a predetermined urging force in a direction toward the neutral position when the watercraft propulsion unit is steered toward at least one of the right direction and the left direction relative to the neutral position; wherein the steering assist device applies the urging force to the steering actuator in the direction toward the neutral position when a steered angle of the watercraft propulsion unit is in a predetermined angle range including a maximum steered angle and does not apply any urging force to the steering actuator when the steered angle of the watercraft propulsion unit is in the neutral position and when the steered angle of the watercraft propulsion unit is outside of the predetermined angle range; and the steering system further comprises a shaft whose axial direction is arranged along the right and left directions of the watercraft hull, the steering actuator is disposed movably along the axial direction of the shaft, and wherein the steering assist device comprises an urging device disposed at end portions of the shaft to press the steering actuator in the direction toward the neutral position.

2. The watercraft steering system according to claim 1, wherein the steering assist device applies the urging force in an opposite direction relative to a direction in which a propeller rotation reaction force is generated when the watercraft propulsion unit is driven.

3. The watercraft steering system according to claim 1, wherein the urging device comprises at least one of a cylinder and piston combination, a coil spring and a torsion spring.

4. The watercraft steering system according to claim 1, wherein the steering actuator is an electrically operable actuator.

5. The watercraft steering system according to claim 1 in combination with a watercraft propulsion unit according mounted to a watercraft.

6. The watercraft steering system according to claim 5, wherein the watercraft propulsion unit is an outboard motor.

7. A steering system for a watercraft arranged to pivot a watercraft propulsion unit laterally relative to a hull of the watercraft from a neutral position in right and left directions with a steering actuator, the steering system comprising:

a left steering assist device and a right steering assist device configured to generate a predetermined force in a direction toward the neutral position when the watercraft propulsion unit is steered toward the right direction and the left direction relative to the neutral position; wherein the left steering assist device or the right steering assist device is configured to apply the predetermined force to the steering actuator in the direction toward the neutral position when a steered angle of the watercraft propulsion unit is in a predetermined angle range including a maximum steered angle and each of the left steering assist device and the right steering assist device is configured not to apply any force to the steering actuator when the steered angle of the watercraft propulsion system is in the neutral position and when the steered angle of the watercraft propulsion system is outside of the predetermined angle range; and the steering system further comprises a shaft whose axial direction is arranged along the right and left directions of the watercraft hull, the steering actuator is disposed movably along the axial direction of the shaft, and wherein each of the left steering assist device and the right steering assist device comprises an urging device disposed at end portions of the shaft and configured to press the steering actuator in the direction toward the neutral position.

8. The watercraft steering system according to claim 7, wherein one of the left steering assist device and the right steering assist device is configured to apply a force larger than the predetermined force in an opposite direction relative to a direction in which propeller rotation reaction force is generated when the watercraft propulsion unit is driven.

9. The watercraft steering system according to claim 7, wherein the urging device comprises at least one of a cylinder and piston combination, a coil spring, and a torsion spring.

10. The watercraft steering system according to claim 7, wherein the steering actuator is an electrically operable actuator.

11. The watercraft steering system according to claim 7 in combination with a watercraft propulsion unit according mounted to a watercraft.

12. The watercraft steering system according to claim 11, wherein the watercraft propulsion unit is an outboard motor.

* * * * *